US009388787B2

(12) United States Patent
Neely et al.

(10) Patent No.: US 9,388,787 B2
(45) Date of Patent: Jul. 12, 2016

(54) METHODS, DEVICES AND SYSTEMS FOR GLOW PLUG OPERATION OF A COMBUSTION ENGINE

(71) Applicant: Southwest Research Institute, San Antonio, TX (US)

(72) Inventors: Gary D. Neely, Boerne, TX (US); Jayant V. Sarlashkar, San Antonio, TX (US)

(73) Assignee: SOUTHWEST RESEARCH INSTITUTE, San Antonio, TX (US)

( * ) Notice: Subject to any disclaimer, the term of this patent is extended or adjusted under 35 U.S.C. 154(b) by 290 days.

(21) Appl. No.: 13/770,809

(22) Filed: Feb. 19, 2013

(65) Prior Publication Data

US 2014/0236460 A1 Aug. 21, 2014

(51) Int. Cl.
*F02P 19/02* (2006.01)
*F02P 21/00* (2006.01)

(52) U.S. Cl.
CPC ..... *F02P 19/021* (2013.01); *F02P 19/028* (2013.01); *F02P 19/023* (2013.01); *F02P 19/025* (2013.01); *F02P 19/026* (2013.01)

(58) Field of Classification Search
CPC ..... F02P 19/028; F02P 19/026; F02P 19/022; F02P 19/023; F02P 19/025; F02P 19/027
USPC ..... 123/145 A, 406.55, 142.5 E, 143 R, 123/169 R, 143 B, 634, 279.21
See application file for complete search history.

(56) References Cited

U.S. PATENT DOCUMENTS

| | | | | |
|---|---|---|---|---|
| 4,499,867 | A | 2/1985 | Linder et al. | |
| 4,594,975 | A | 6/1986 | Shigenobu | |
| 4,607,153 | A | 8/1986 | Ang et al. | |
| 4,635,594 | A | 1/1987 | Ichikawa et al. | |
| 4,671,224 | A | 6/1987 | Yasuhara | |
| 5,144,922 | A | 9/1992 | Kong | |
| 5,724,932 | A * | 3/1998 | Antone | 123/145 A |
| 6,009,369 | A * | 12/1999 | Boisvert et al. | 701/99 |
| 6,227,157 | B1 * | 5/2001 | Baumgartner et al. | 123/145 A |
| 6,363,316 | B1 * | 3/2002 | Soliman et al. | 701/104 |
| 6,637,392 | B2 * | 10/2003 | Jung | 123/145 A |
| 7,431,004 | B2 | 10/2008 | Kernwein et al. | |
| 7,658,174 | B2 | 2/2010 | Stoller | |
| 7,900,599 | B2 | 3/2011 | Dittus et al. | |
| 7,925,422 | B2 | 4/2011 | Hiramatsu | |
| 8,006,663 | B2 * | 8/2011 | Hosaka | 123/143 R |
| 8,082,090 | B2 | 12/2011 | Kernwein et al. | |
| 8,131,416 | B2 | 3/2012 | Thompson | |
| 8,281,772 | B2 * | 10/2012 | Kurtz et al. | 123/676 |
| 8,701,614 | B2 * | 4/2014 | Cassani | 123/145 A |
| 2002/0133286 | A1 * | 9/2002 | Kolmanovsky et al. | 701/104 |

(Continued)

*Primary Examiner* — Lindsay Low
*Assistant Examiner* — George Jin
(74) *Attorney, Agent, or Firm* — Grossman, Tucker et al

(57) ABSTRACT

A glow plug control apparatus for an engine of a motor vehicle, comprising at least one glow plug; a power source to apply electric power to the at least one glow plug; and a control unit comprising a microprocessor configured and arranged to determine glow plug supply power to be applied from the power source to the at least one glow plug based on input from stored vehicle data and from a plurality of engine sensors, wherein the input includes data of engine operating parameters including fresh air intake mass airflow, intake manifold total mass airflow, intake manifold temperature, coolant temperature, glow plug temperature and total fuel injection quantity.

29 Claims, 7 Drawing Sheets

(56) References Cited

U.S. PATENT DOCUMENTS

Figure 2:
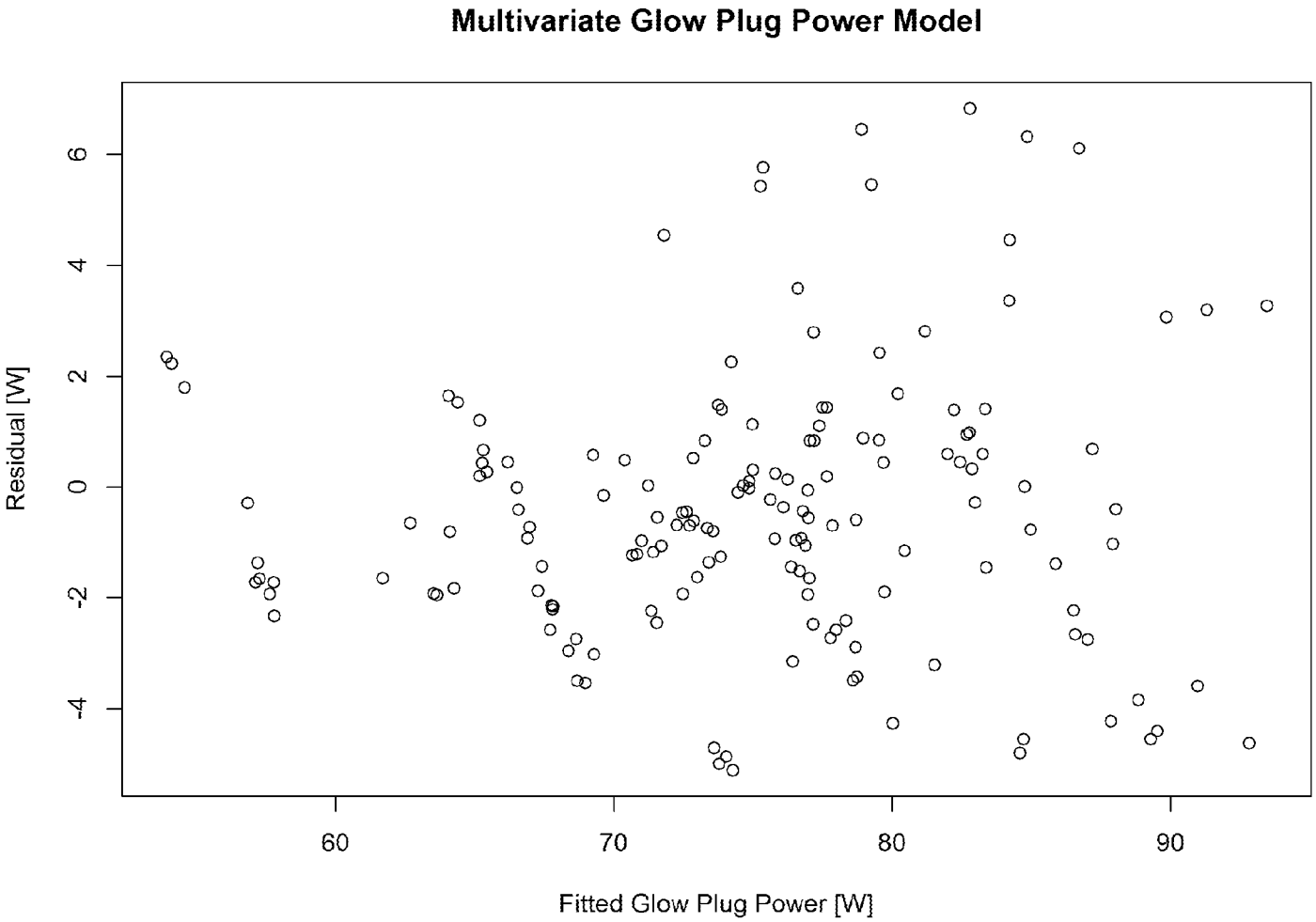

2006/0241849 A1* 10/2006 Gangopadhyay ..... 701/108
2007/0289572 A1* 12/2007 Petridis et al. ..... 123/305
2009/0165544 A1* 7/2009 Sun et al. ..... 73/114.74
2009/0289051 A1* 11/2009 Cassani et al. ..... 219/497
2009/0306877 A1* 12/2009 Sasaki et al. ..... 701/104
2010/0126464 A1* 5/2010 Schumacher et al. ..... 123/350
2010/0280735 A1* 11/2010 Moritz et al. ..... 701/102
2011/0041818 A1* 2/2011 Kernwein et al. ..... 123/623
2011/0295525 A1* 12/2011 Tsukamoto et al. ..... 702/47

* cited by examiner

FIG. 1

| Dependent Variable | | | | | | |
|---|---|---|---|---|---|---|
| | 1 | 2 | 3 | 4 | 5 | 6 |
| Glow Plug Power [W] | Glow Plug Temp [C] | Fuel Quantity [kg/h] | Fresh Air Intake Mass Airflow [kg/h] | Intake Manifold MAF [kg/h] | Intake Manifold Temp [C] | Coolant Temp [C] |
| 56.1 | 1073 | 0.95 | 79.1 | 86.0 | 29.0 | 24.4 |
| 65.9 | 1203 | 0.89 | 79.2 | 86.1 | 29.4 | 24.7 |
| 75.0 | 1314 | 0.86 | 79.2 | 85.8 | 29.8 | 24.8 |
| 75.9 | 1321 | 0.86 | 79.1 | 85.8 | 29.9 | 24.9 |
| 77.8 | 1337 | 0.82 | 79.1 | 85.7 | 30.1 | 25.0 |
| 55.9 | 1076 | 1.48 | 81.0 | 88.5 | 31.4 | 25.7 |
| 65.7 | 1204 | 1.48 | 80.8 | 88.4 | 31.6 | 25.6 |
| 75.1 | 1312 | 1.49 | 81.0 | 88.5 | 31.8 | 25.5 |
| 78.1 | 1336 | 1.50 | 81.0 | 88.4 | 32.1 | 25.4 |
| 55.7 | 1096 | 2.20 | 82.4 | 91.1 | 33.0 | 26.3 |
| 65.6 | 1217 | 2.16 | 82.2 | 90.8 | 33.5 | 26.4 |
| 74.9 | 1321 | 2.17 | 82.4 | 90.9 | 33.7 | 26.6 |
| 77.1 | 1338 | 2.16 | 82.4 | 90.9 | 34.1 | 26.6 |
| 56.4 | 999 | 1.60 | 134.0 | 147.3 | 38.3 | 24.6 |
| 66.0 | 1130 | 1.60 | 133.1 | 146.1 | 40.5 | 24.9 |
| 75.3 | 1242 | 1.62 | 133.0 | 146.2 | 40.9 | 25.0 |
| 84.3 | 1318 | 1.62 | 133.0 | 145.9 | 41.4 | 25.1 |
| 56.3 | 1009 | 2.42 | 138.6 | 152.5 | 44.4 | 26.0 |
| 66.0 | 1135 | 2.42 | 138.3 | 152.3 | 45.1 | 26.0 |
| 75.4 | 1241 | 2.40 | 138.1 | 152.1 | 45.4 | 26.2 |
| 84.4 | 1318 | 2.42 | 138.2 | 152.1 | 45.8 | 26.2 |
| 56.4 | 1052 | 3.46 | 118.8 | 130.3 | 39.7 | 27.2 |
| 66.2 | 1175 | 3.45 | 118.8 | 130.6 | 38.4 | 27.3 |
| 75.8 | 1282 | 3.45 | 119.1 | 130.9 | 37.7 | 27.2 |
| 82.8 | 1339 | 3.45 | 119.0 | 131.1 | 37.1 | 27.4 |
| 66.3 | 1087 | 1.91 | 179.4 | 201.9 | 44.0 | 26.3 |
| 75.7 | 1198 | 1.90 | 178.3 | 199.6 | 47.0 | 26.3 |
| 84.7 | 1276 | 1.91 | 178.3 | 199.3 | 47.8 | 26.4 |
| 88.1 | 1307 | 1.91 | 177.7 | 198.9 | 48.3 | 26.4 |

FIG. 1 cont

| | | | | | | |
|---|---|---|---|---|---|---|
| 66.4 | 1077 | 3.49 | 205.0 | 232.0 | 54.2 | 25.6 |
| 75.8 | 1185 | 3.47 | 202.5 | 227.6 | 60.9 | 27.2 |
| 84.2 | 1250 | 3.44 | 202.7 | 227.4 | 62.0 | 28.2 |
| 87.3 | 1280 | 3.38 | 202.7 | 227.3 | 61.1 | 28.4 |
| 66.0 | 1140 | 4.56 | 155.3 | 173.9 | 44.6 | 29.2 |
| 75.6 | 1240 | 4.54 | 156.5 | 176.2 | 40.7 | 29.3 |
| 84.7 | 1315 | 4.63 | 156.9 | 177.0 | 40.2 | 29.3 |
| 87.6 | 1344 | 4.60 | 157.2 | 177.1 | 40.1 | 29.4 |
| 55.5 | 1071 | 0.76 | 77.1 | 83.3 | 36.0 | 40.3 |
| 65.4 | 1201 | 0.79 | 77.4 | 83.7 | 35.3 | 40.3 |
| 74.7 | 1309 | 0.83 | 77.6 | 83.8 | 35.6 | 39.0 |
| 55.6 | 1092 | 2.11 | 80.6 | 89.0 | 36.2 | 41.2 |
| 65.4 | 1213 | 2.12 | 80.7 | 89.2 | 36.7 | 40.6 |
| 74.8 | 1316 | 2.11 | 80.8 | 89.1 | 36.9 | 40.0 |
| 65.7 | 1068 | 2.09 | 190.7 | 217.3 | 50.7 | 40.1 |
| 75.1 | 1176 | 2.08 | 190.0 | 215.9 | 53.2 | 40.6 |
| 83.6 | 1252 | 2.11 | 190.0 | 215.4 | 54.5 | 40.6 |
| 65.7 | 1132 | 4.45 | 160.9 | 181.0 | 45.1 | 39.7 |
| 75.4 | 1236 | 4.44 | 161.2 | 181.4 | 44.2 | 40.8 |
| 84.2 | 1308 | 4.51 | 161.2 | 181.8 | 44.3 | 40.5 |
| 55.4 | 1060 | 0.64 | 76.3 | 82.9 | 40.3 | 59.4 |
| 65.1 | 1191 | 0.64 | 76.2 | 82.8 | 40.6 | 60.7 |
| 70.6 | 1239 | 0.69 | 77.5 | 84.6 | 41.0 | 61.4 |
| 75.8 | 1300 | 0.67 | 77.7 | 84.8 | 40.9 | 60.4 |
| 56.6 | 1085 | 2.11 | 81.9 | 91.0 | 39.1 | 60.5 |
| 66.5 | 1202 | 2.10 | 81.8 | 90.9 | 39.9 | 61.9 |
| 76.1 | 1304 | 2.13 | 81.7 | 90.8 | 40.1 | 60.3 |
| 65.7 | 1054 | 2.13 | 195.7 | 224.9 | 52.9 | 59.8 |
| 75.0 | 1158 | 2.11 | 194.8 | 223.2 | 55.7 | 60.6 |
| 83.9 | 1236 | 2.10 | 194.2 | 222.3 | 56.6 | 59.8 |
| 65.9 | 1129 | 4.07 | 150.0 | 169.5 | 49.6 | 59.9 |
| 75.7 | 1234 | 4.11 | 152.4 | 173.7 | 43.2 | 59.7 |
| 84.7 | 1300 | 4.06 | 152.4 | 173.9 | 42.9 | 60.9 |
| 0.0 | 278 | 1.50 | 56.1 | 88.4 | 69.7 | 26.8 |
| 65.2 | 1205 | 1.57 | 56.0 | 88.8 | 68.4 | 26.7 |
| 73.3 | 1296 | 1.57 | 55.8 | 88.8 | 68.4 | 26.7 |
| 79.3 | 1345 | 1.58 | 55.7 | 88.8 | 68.6 | 26.7 |

FIG. 1 cont

| | | | | | | |
|---|---|---|---|---|---|---|
| 0.0 | 332 | 2.61 | 57.3 | 87.3 | 86.9 | 28.6 |
| 65.4 | 1200 | 2.73 | 56.7 | 87.0 | 89.7 | 28.9 |
| 74.1 | 1298 | 2.73 | 56.5 | 86.4 | 92.5 | 29.3 |
| 79.9 | 1345 | 2.70 | 56.3 | 86.1 | 94.1 | 29.3 |
| 71.4 | 1205 | 2.95 | 93.1 | 154.5 | 107.8 | 28.8 |
| 82.7 | 1302 | 2.93 | 92.7 | 153.2 | 111.1 | 29.1 |
| 87.8 | 1347 | 2.95 | 91.7 | 152.4 | 112.3 | 29.2 |
| 0.0 | 346 | 2.87 | 89.6 | 150.3 | 113.0 | 29.2 |
| 0.0 | 457 | 5.21 | 106.2 | 162.6 | 133.1 | 32.3 |
| 69.8 | 1200 | 5.38 | 105.5 | 160.0 | 140.9 | 33.0 |
| 81.9 | 1299 | 5.36 | 104.2 | 157.8 | 144.6 | 33.3 |
| 87.5 | 1345 | 5.39 | 103.7 | 156.9 | 146.7 | 33.4 |
| 61.7 | 1199 | 1.57 | 53.6 | 61.8 | 32.3 | 25.2 |
| 70.0 | 1299 | 1.59 | 53.9 | 62.4 | 30.6 | 25.4 |
| 61.6 | 1197 | 1.57 | 53.8 | 62.4 | 30.2 | 25.5 |
| 74.3 | 1347 | 1.58 | 53.9 | 62.4 | 30.2 | 25.5 |
| 62.5 | 1206 | 1.59 | 45.1 | 61.8 | 38.3 | 26.1 |
| 71.0 | 1305 | 1.59 | 45.1 | 61.3 | 42.0 | 26.3 |
| 74.6 | 1347 | 1.58 | 45.0 | 61.1 | 44.1 | 26.6 |
| 60.1 | 1195 | 2.75 | 59.2 | 69.4 | 33.4 | 29.1 |
| 69.5 | 1300 | 2.73 | 59.2 | 69.5 | 32.5 | 29.3 |
| 73.4 | 1343 | 2.72 | 59.4 | 69.6 | 32.3 | 29.4 |
| 62.0 | 1198 | 2.70 | 54.6 | 71.1 | 45.1 | 29.8 |
| 70.9 | 1299 | 2.71 | 54.6 | 71.1 | 45.8 | 30.0 |
| 75.2 | 1343 | 2.71 | 54.4 | 71.1 | 46.5 | 30.8 |
| 70.6 | 1198 | 2.66 | 136.2 | 153.0 | 41.1 | 28.9 |
| 81.9 | 1303 | 2.71 | 137.0 | 155.8 | 34.9 | 28.6 |
| 86.8 | 1346 | 2.70 | 137.2 | 156.3 | 33.8 | 28.6 |
| 63.3 | 1203 | 5.08 | 106.1 | 122.3 | 41.1 | 32.9 |
| 72.6 | 1301 | 5.07 | 107.1 | 124.2 | 37.3 | 31.6 |
| 77.8 | 1348 | 5.07 | 107.4 | 124.7 | 36.4 | 31.6 |
| 35.1 | 419 | 4.96 | 107.3 | 123.9 | 35.5 | 31.5 |
| 66.6 | 1200 | 4.97 | 104.6 | 134.0 | 50.5 | 32.1 |
| 75.4 | 1299 | 4.97 | 104.0 | 132.2 | 55.2 | 32.2 |
| 81.8 | 1348 | 5.02 | 104.0 | 131.9 | 57.5 | 32.3 |
| 35.1 | 421 | 4.92 | 104.2 | 131.0 | 58.4 | 32.3 |
| 68.8 | 1199 | 2.87 | 146.5 | 165.9 | 34.8 | 28.2 |

FIG. 1 cont

| | | | | | | |
|---|---|---|---|---|---|---|
| 68.9 | 1197 | 2.87 | 146.8 | 166.4 | 34.3 | 28.3 |
| 69.2 | 1203 | 2.79 | 145.6 | 165.4 | 34.0 | 28.4 |
| 79.7 | 1299 | 2.79 | 145.8 | 165.6 | 34.0 | 28.3 |
| 85.1 | 1345 | 2.77 | 145.9 | 165.7 | 34.0 | 28.3 |
| 69.2 | 1201 | 2.77 | 133.1 | 162.6 | 36.8 | 28.5 |
| 80.1 | 1302 | 2.78 | 132.8 | 161.8 | 38.1 | 28.6 |
| 85.0 | 1342 | 2.77 | 132.9 | 161.6 | 39.3 | 28.7 |
| 78.3 | 1301 | 2.77 | 120.9 | 149.1 | 41.8 | 28.7 |
| 70.2 | 1322 | 0.67 | 35.0 | 44.7 | 31.4 | 26.7 |
| 69.4 | 1320 | 0.91 | 34.2 | 44.8 | 31.6 | 27.9 |
| 69.6 | 1329 | 1.24 | 33.5 | 46.6 | 34.1 | 28.7 |
| 69.1 | 1348 | 1.66 | 32.3 | 46.2 | 43.8 | 30.9 |
| 65.6 | 1289 | 1.56 | 34.2 | 47.7 | 41.7 | 29.6 |
| 66.3 | 1316 | 1.99 | 37.8 | 52.0 | 41.7 | 30.1 |
| 65.4 | 1314 | 2.35 | 41.1 | 55.4 | 36.4 | 30.5 |
| 72.7 | 1302 | 0.97 | 56.0 | 69.9 | 38.9 | 25.4 |
| 72.2 | 1301 | 1.32 | 55.8 | 70.5 | 36.7 | 25.4 |
| 72.0 | 1317 | 1.83 | 52.7 | 68.7 | 38.0 | 26.6 |
| 72.0 | 1326 | 2.37 | 53.2 | 69.5 | 40.1 | 27.6 |
| 72.2 | 1323 | 2.31 | 51.4 | 70.2 | 47.0 | 27.8 |
| 71.6 | 1333 | 2.90 | 55.1 | 71.1 | 48.1 | 28.7 |
| 72.6 | 1346 | 3.44 | 64.5 | 80.8 | 43.9 | 29.7 |
| 76.4 | 1301 | 1.62 | 82.7 | 101.3 | 39.8 | 25.1 |
| 76.9 | 1299 | 1.39 | 82.8 | 101.1 | 38.7 | 24.7 |
| 76.3 | 1306 | 1.99 | 81.6 | 101.2 | 38.0 | 25.4 |
| 76.3 | 1298 | 1.84 | 81.2 | 100.3 | 38.8 | 25.5 |
| 76.0 | 1298 | 1.85 | 78.1 | 97.5 | 39.5 | 25.6 |
| 75.3 | 1315 | 2.82 | 74.1 | 94.7 | 42.0 | 27.1 |
| 74.8 | 1322 | 3.21 | 73.8 | 94.6 | 46.2 | 27.5 |
| 75.0 | 1320 | 3.21 | 71.8 | 95.0 | 50.6 | 27.5 |
| 75.3 | 1320 | 4.15 | 76.7 | 100.0 | 55.1 | 28.3 |
| 76.5 | 1325 | 4.85 | 87.4 | 112.1 | 52.4 | 28.9 |
| 80.3 | 1292 | 1.85 | 108.4 | 131.9 | 50.3 | 25.1 |
| 80.1 | 1292 | 1.89 | 109.2 | 134.5 | 42.0 | 24.8 |
| 79.8 | 1292 | 2.45 | 108.3 | 135.0 | 40.4 | 25.3 |
| 78.5 | 1304 | 3.59 | 102.0 | 129.4 | 45.6 | 26.7 |
| 77.9 | 1306 | 4.07 | 103.4 | 131.3 | 49.6 | 27.8 |

FIG. 1 cont

| | | | | | | |
|---|---|---|---|---|---|---|
| 78.9 | 1326 | 5.31 | 106.1 | 137.2 | 59.1 | 29.9 |
| 78.0 | 1304 | 3.97 | 98.7 | 127.8 | 65.3 | 28.5 |
| 79.1 | 1328 | 5.25 | 103.2 | 134.5 | 66.9 | 29.6 |
| 80.2 | 1318 | 6.10 | 114.4 | 146.8 | 65.6 | 30.6 |
| 83.8 | 1297 | 2.35 | 136.5 | 169.3 | 50.1 | 26.2 |
| 83.6 | 1294 | 3.00 | 138.8 | 173.6 | 45.9 | 26.5 |
| 83.7 | 1295 | 2.97 | 132.9 | 172.4 | 49.3 | 26.7 |
| 83.2 | 1313 | 4.34 | 133.9 | 173.9 | 54.3 | 27.6 |
| 82.5 | 1306 | 4.88 | 131.9 | 175.3 | 63.8 | 28.9 |
| 83.6 | 1324 | 6.05 | 130.9 | 176.3 | 80.3 | 30.7 |
| 83.9 | 1322 | 7.34 | 146.9 | 191.5 | 79.9 | 32.4 |
| 76.3 | 1182 | -0.01 | 117.9 | 131.8 | 31.0 | 29.0 |
| 81.1 | 1222 | -0.01 | 117.9 | 131.8 | 30.8 | 29.1 |
| 85.3 | 1261 | -0.01 | 117.8 | 131.7 | 30.8 | 29.1 |
| 89.6 | 1304 | -0.01 | 118.3 | 131.7 | 30.8 | 29.1 |
| 91.1 | 1326 | -0.01 | 118.0 | 131.8 | 30.7 | 29.1 |
| 92.8 | 1347 | -0.01 | 117.8 | 132.0 | 30.7 | 29.2 |
| 80.7 | 1169 | -0.01 | 152.6 | 176.0 | 30.8 | 28.9 |
| 84.7 | 1207 | -0.01 | 152.7 | 176.2 | 31.1 | 28.9 |
| 88.6 | 1255 | -0.01 | 152.5 | 176.1 | 31.4 | 29.0 |
| 92.8 | 1309 | -0.01 | 152.5 | 176.1 | 31.6 | 29.1 |
| 94.4 | 1323 | -0.01 | 152.2 | 176.0 | 31.7 | 29.1 |
| 96.7 | 1344 | -0.01 | 152.2 | 176.0 | 31.8 | 29.0 |
| 71.3 | 1337 | 2.88 | 55.9 | 71.0 | 38.3 | 32.8 |
| 72.1 | 1359 | 3.55 | 66.0 | 80.6 | 37.2 | 32.4 |
| 69.1 | 1354 | 1.33 | 35.0 | 45.5 | 40.7 | 34.7 |

METHODS, DEVICES AND SYSTEMS FOR GLOW PLUG OPERATION OF A COMBUSTION ENGINE

FIELD OF THE INVENTION

This disclosure relates to methods, devices and systems to control the glow plug operation of a combustion engine, particularly controlling power to the glow plug(s) as a means to indirectly control the resulting glow plug temperature.

BACKGROUND

Diesel engines, unlike gasoline engines, do not use spark plugs to induce combustion. Rather, diesel engines rely on compression to raise the temperature of air in the cylinder (taken in during the intake stroke) to a temperature such that, when diesel fuel is introduced to the hot compressed air, the diesel fuel will spontaneously combust. When the piston reaches the top of its travel path, or near top dead center, a fuel mist is typically injected into the cylinder, which instantly combusts, forcing the piston downwards and generating power.

In a cold environment, particularly if a diesel engine has not been running for several hours, the engine block similarly becomes cold and, when attempting to start the engine, acts as a heat sink, quickly dissipating the heat generated by the pistons compressing air. As a result, the engine may be unable to start because it cannot generate and maintain enough heat to ignite the diesel fuel.

Compounding this problem is the fuel itself. During cold start-up, the diesel fuel becomes more difficult to ignite. Without being bound to a particular theory, during cold weather starting, all of the diesel fuel may not evaporate. As temperature decreases, the viscosity of the diesel fuel may be understood to increase, which adversely influences the spray pattern when the fuel is injected into the cylinder. Furthermore, the vapor pressure of diesel fuel also decreases with decreasing temperature making the fuel less volatile. Thus, upon injection, a portion of the fuel may not ignite. In order to compensate for such loss in fuel, the quantity of fuel injected may be typically increased. As such, the engine may be required to run more rich during start-up, and produce higher emissions in the form of unburned hydrocarbons.

A glow plug is a heating device which is typically used to aid the starting of diesel engines. A glow plug includes a heating element at the tip which, when electrified, heats by means of electrical resistance. Each cylinder of the diesel engine typically includes a glow plug. Heat generated by a glow plug promotes ignition of the fuel mist near the glow plug tip which leads to increased in-cylinder temperature and subsequent combustion of the rest of the fuel.

Glow plugs are typically activated for a time period (e.g. few seconds) before attempting to start the engine, which may be referred to as a "pre-glow" period. In addition to helping with engine starting, the glow plugs may remain on while the engine warms up (i.e. post starting) to a predetermined temperature, which may be referred to as "post-glow" period or "after-glow" period. Such use of the glow plugs while the engine warms up may improve combustion stability and/or reduce harmful exhaust emissions, such as unburned hydrocarbons (HC). However, such use may also increase fuel consumption.

For example, by glowing the glow plugs from a few seconds before engine start to an engine temperature of 40° C., hydrocarbon emissions may be decreased. However, use of the glow plugs for such a duration may increase the power consumption to the glow system, as well as fuel consumption, leading to an increase in carbon dioxide production. Thus, a balance of competing interests should be considered when using glow plugs.

Modern glow plugs are capable of temperatures of up to 1300° C., with the temperature thereof being a function of the supplied power (e.g. voltage). Determination and application of the power level for glow plugs during engine warm-up generally varies by vehicle manufacturer. Some manufacturers may adjust power to the glow plugs during warm-up simply as a function of engine speed. Other manufactures may adjust power to the glow plugs during warm-up as a function of engine speed and pedal position. For both of these approaches, the applied power (voltage) may be determined solely from a look-up table.

The selection of the applied voltage from the look-up table may be simply based on the resistance of the glow plug. In other words, by knowing the electrical resistance of the glow plug, and the power applied to the glow plug, a theoretical temperature for the glow plug may be determined. However, while glow plug temperature may be a function of the applied power level, unaccounted for secondary factors may lead to significant deviations from the theoretical temperature of the glow plug. Ignoring these secondary factors may lead to glow plug temperature levels well outside targeted ranges, such as below the maximum temperature available, over a large engine operation area which limits the potential benefit from the glow plugs to improve combustion stability and/or reduce harmful exhaust emissions. What is needed is a glow plug control apparatus which more accurately models power to be supplied to the glow plug(s), based on a number of engine operating variables, as a means to better indirectly control the resulting glow plug temperature.

SUMMARY

The present disclosure provides methodologies and structures for improved glow plug control which may be used with methods, apparatus/devices and systems associated with operating a combustion engine, particularly of a motor vehicle.

In various embodiments, the methodology and structures may include use of a mathematical model, which may be particularly in the form of an equation, which determines glow plug power to be applied from a glow plug power source to at least one glow plug based on input from stored vehicle data and from a plurality of engine sensors. In such manner, the glow plug(s) may achieve an actual temperature more representative of a predetermined/targeted temperature. Such may provide combustion improvement, such as stability and/or emissions (e.g. HC) reduction, during warm-up, which may be for a predetermined period after starting, or to a predetermined engine temperature.

In certain embodiments, a glow plug control apparatus for an engine of a motor vehicle may comprise at least one glow plug; a power source to apply electric power to the at least one glow plug; and a control unit comprising a microprocessor configured and arranged to determine glow plug supply power to be applied from the power source to the at least one glow plug based on input from stored vehicle data and from a plurality of engine sensors, wherein the input includes data of engine operating parameters including fresh air intake mass airflow, intake manifold total mass airflow, intake manifold temperature, coolant temperature, glow plug temperature and total fuel injection quantity.

In certain embodiments, the plurality of sensors may include a fresh air intake mass airflow sensor to provide data of fresh air intake mass airflow from the engine, an intake manifold temperature sensor to provide data of intake manifold temperature from the engine, and a coolant temperature sensor to provide data of coolant temperature from the engine.

In certain embodiments, the plurality of sensors may further include an intake manifold pressure sensor to provide data of intake manifold pressure of the engine, which may be used with the data of intake mass airflow and intake manifold temperature, as well as a predetermined map of volumetric efficiency, to calculate intake manifold total mass airflow.

In certain embodiments, the stored vehicle data may include the predetermined data of targeted glow plug temperature, which may be provided from at least one-look-up table contained in a memory of the vehicle.

In certain embodiments, the fuel quantity command is issued from the vehicle's electronic control unit based on accelerator pedal position, engine speed (rpm) and one or more maps stored in a memory of the vehicle.

In certain embodiments, the microprocessor may be configured and arranged to determine glow plug power to be applied from the power source to the at least one glow plug using a model which equates the engine operating parameters of fresh air intake mass airflow, intake manifold total mass airflow, intake manifold temperature, coolant temperature, glow plug temperature and total fuel injection quantity to the glow plug supply power to be applied from the glow plug power source. The model may be a nonlinear function.

In certain embodiments, the engine operating parameters of fresh air intake mass airflow, intake manifold total mass airflow, intake manifold temperature, coolant temperature, glow plug temperature and total fuel injection quantity may each define an independent variable of the model.

In certain embodiments, at least two of the engine operating parameters of fresh air intake mass airflow, intake manifold total mass airflow, intake manifold temperature, coolant temperature, glow plug temperature and total fuel injection quantity may define a cross-variable of the model.

In certain embodiments, the microprocessor is configured and arranged to determine the glow plug power to be applied from the power source to the at least one glow plug using an equation of $$\begin{aligned}\text{GP_Power}=&a+(b*\text{GP_Temp})+(c*\text{Air_Intake_MAF})+\\&(d*\text{Intake_Manifold_MAF})+\\&(e*\text{Intake_Manifold_Temp})+(f*\text{Coolant_Temp})+\\&(g*\text{Fuel_Quantity})+\\&(h*\text{GP_Temp}*\text{Intake_Manifold_MAF})\end{aligned}$$

where:

GP_Power=the glow plug supply power;

GP_Temp=the glow plug temperature;

Air_Intake_MAF=the fresh air intake mass airflow;

Intake_Manifold_MAF=the intake manifold total mass airflow;

Intake_Manifold_Temp=the intake manifold temperature;

Coolant_Temp=the engine coolant temperature;

Fuel_Quantity=the total fuel injection quantity per injection period; and wherein the letters a-h are coefficient values.

In certain embodiments, a method of glow plug control for a motor vehicle may comprise providing a glow plug control apparatus comprising:

at least one glow plug;

a power source to apply electric power to the at least one glow plug;

a control unit comprising a microprocessor configured and arranged to determine glow plug supply power to be applied from the power source to the at least one glow plug based on input from stored vehicle data and from a plurality of engine sensors, wherein the input includes data of engine operating parameters including fresh air intake mass airflow, intake manifold total mass airflow, intake manifold temperature, coolant temperature, glow plug temperature and total fuel injection quantity;

providing data of fresh air intake mass airflow, intake manifold total mass airflow, intake manifold temperature, coolant temperature, glow plug temperature and total fuel quantity to the control unit;

determining glow plug power to be applied from the power source to the at least one glow plug with the microprocessor based on the data of fresh air intake mass airflow, intake manifold total mass airflow, intake manifold temperature, coolant temperature, glow plug temperature and total fuel injection quantity provided to the control unit.

In certain embodiments, the data of fresh air intake mass airflow is provided from a fresh air intake mass airflow sensor of the engine, the data of intake manifold temperature is provided from an intake manifold temperature sensor of the engine, the data of coolant temperature is provided from a coolant temperature sensor of the engine and the data of intake manifold total mass airflow is calculated from intake mass airflow, intake manifold temperature, intake manifold pressure and a predetermined map of volumetric efficiency.

In certain embodiments, the method may include providing the data of the fresh air intake mass airflow, the intake manifold total mass airflow, the intake manifold temperature and the coolant temperature to the control unit further comprises providing the data of the fresh air intake mass airflow, the intake manifold total mass airflow, the intake manifold temperature and the coolant temperature to the control unit from the plurality of sensors, wherein the plurality of sensors comprise a fresh air intake mass airflow sensor, an intake manifold pressure sensor, an intake manifold temperature sensor and a coolant temperature sensor.

FIGURES

Figure 3:
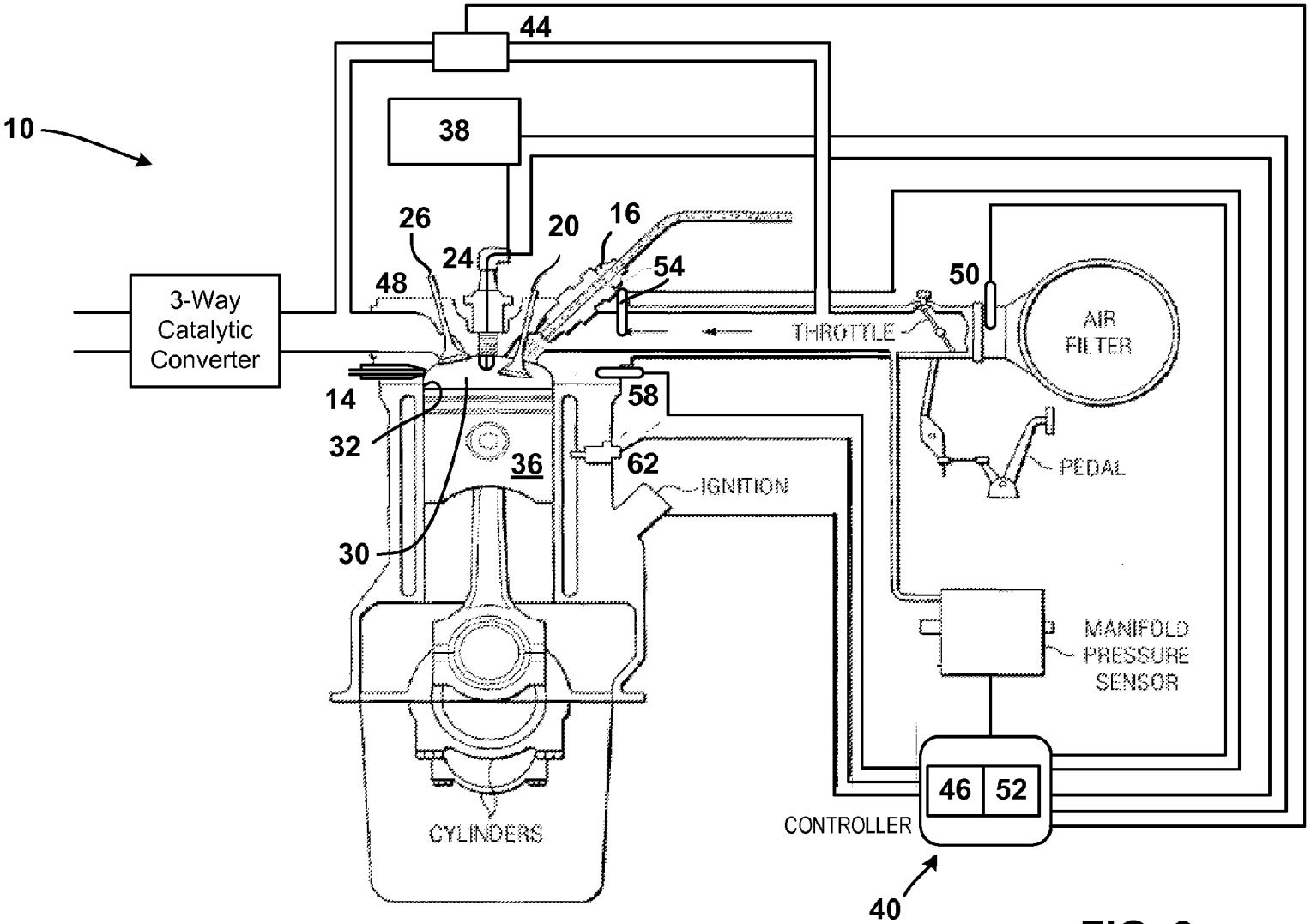

The above-mentioned and other features of this disclosure, and the manner of attaining them, will become more apparent and better understood by reference to the following description of embodiments described herein taken in conjunction with the accompanying drawings, wherein:

FIG. 1 shows a table of data used to provide the multiple regression analysis according to the present disclosure; and FIG. 2 shows a plot of residual v. fitted glow plug power for the multiple regression analysis; and FIG. 3 illustrates an exemplary engine having a control unit, glow plug, glow plug power supply and a plurality of sensors in accordance with the present disclosure.

DETAILED DESCRIPTION

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

To provide the various methods and apparatus for glow plug control according to the present disclosure, engine operating data from a test engine was first collected at steady state conditions of constant load and RPM, particularly to identify engine operating parameters/variables which may better determine a suitable glow plug power to achieve a particular glow plug temperature.

As shown in FIG. 1, in addition to data of glow plug supplied power (watts) and glow plug temperature (° C.), this data included data of total fuel quantity (kg/h), fresh air intake mass airflow (kg/h), intake manifold total mass airflow (MAF) (kg/h), intake manifold temperature (° C.) and coolant temperature (° C.). It should be noted that in order to obtain glow plug temperature data, the glow plugs of the test engine were equipped with thermocouples which would not be necessarily required for production.

The foregoing data was then subjected to a regression analysis in which the glow plug power was set as the dependent variable, while the remaining variables of glow plug temperature, fuel quantity, fresh air intake mass airflow, intake manifold total mass airflow, intake manifold temperature and coolant temperature were set as independent variables. Furthermore, from further review of the data, it was uncovered that certain independent variables, in particular glow plug temperature and intake manifold total mass airflow were cross-variables. In other words, the effect of glow plug temperature on the glow plug power was amplified or diminished by the magnitude of the intake manifold total mass airflow.

When a multiple regression analysis was performed with the data shown in FIG. 1, the regression analysis was found to have a coefficient of multiple determination of 0.9283. During the multiple regression analysis, the "t-value" and "Pr(>|t|)" of the various coefficients a-h was used to decide which variables were truly influential. The coefficients for the independent variables were as follows: the "0" coefficients below indicate that the inclusion of the corresponding variable did not have statistically significant impact on the glow plug power (i.e., they were not truly influential). The quantities entering the equation below are normalized; e.g., GP_Temp=(GP_Temp in physical units−μ(GP_Temp))/σ(GP_Temp); where μ(.) and σ(.) are the mean and standard deviation of the dataset used in regression analysis.

$$GP_Power=0+(1.15634*GP_Temp)+(0*Air_Intake_MAF)+(0.41699*Intake_Manifold_MAF)+(0*Intake_Manifold_Temp)+(0*Coolant_Temp)+(-0.19372*Fuel_Quantity)+(0.18891*GP_Temp*Intake_Manifold_MAF)$$

From the multiple regression analysis, coefficients a-h of the forgoing equation (as identified in the summary) were determined to fit the data of FIG. 1.

The quality of fit may be assessed by considering the difference between the true (measured) and fitted values. The residual may then be plotted against the fitted values and examined for patterns or trends. The search for a model/equation form may be considered complete when the residual appears to be reasonably well distributed around zero and is of acceptably small magnitude.

For the foregoing model of glow plug power, the difference between the actual glow plug power and the corresponding fitted value was examined and a plot of this residual power [W] against the fitted glow plug power [W] created as shown in FIG. 2. The plot verifies that the model fits the data fairly well since the magnitude of residual is below 5 watts for most of the data.

It should be noted that other methods data of normalization are available and could be used.

The foregoing nonlinear model was then validated for both steady-state and transient engine operation using the test engine with observed glow plug temperature deviations of actual versus predicted values of less than ±50° C. during the worse case scenario of transient operation.

Based on emission measurements made during transient engine operation, this level of temperature control represents a significant reduction in HC emissions compared to current glow plug control.

| | Test Engine Operated Without Model | Test Engine Operated With Model |
|---|---|---|
| HC emissions (grams) | 1.83 | 0.78 |

U.S. Federal Test Procedure FTP-75, test cell simulation, first hill, time period from 0 to 114 seconds.

Referring now to FIG. 3, there is shown an internal combustion engine 10 according to the present disclosure which may make use of the foregoing glow plug control model. Engine 10 may particularly be a 4, 6 or 8 cylinder engine, which may be coupled to a transmission (not shown). In certain embodiments, internal combustion engine may particularly comprise a compression-ignition (diesel) engine.

Engine 10 may include one or more fuel injectors per cylinder, which may include one or more fuel injectors 14 for direct injection (i.e. an injector which injects directly into the cylinder/combustion chamber 30, which may be referred to as a direct fuel injector) or one or more fuel injectors 16 for indirect injection (i.e. an injector which does not inject directly into the cylinder/combustion chamber 30, but rather generally before the intake valve 20 such as with intake port injection).

Engine 10 may particularly be a four-stroke diesel engine (i.e. an intake stroke, compression stroke, power (ignition stroke) and exhaust stroke), which may include a heating device to heat the cylinder 32, such as a glow plug 24. Glow plug 24 may be particularly utilized for combustion improvement, such as stability and/or emissions (e.g. HC) reduction, during starting and warm-up of the engine 10, particularly before the engine 10 has reached a predetermined operating temperature. For example, glow plug 24 may be utilized while the engine's temperature is below 40° C., 30° C., 20° C., 10° C., 0° C., −10° C., −20° C. or any other predetermined temperature, at which such time use of the glow plug 24 may terminate when the predetermined temperature is attained. Glow plug 24 may also be used for a predetermined time period not to exceed 30 sec, 1 minute, 2 minutes, 5 minutes or any other predetermined time. Predetermined temperature and time limitations may also be used in conjunction with one another (e.g. use of the glow plug when the engine's temperature is below 30° C., but not to exceed 2 minutes).

Glow plug 24 may be used to provide heat directly into the combustion chamber 30, which may particularly heat the wall of the cylinder 32 and piston head 36. This may aid in reducing the amount of thermal diffusion which will occur when attempting to start and warm-up the engine 10 when the engine is cold. Glow plug 24 may be a metal rod glow plug, a ceramic glow plug or any other suitable glow plug. Glow plug 24 may have a maximum use temperature of 1,000° C., 1,100° C., 1,200° C., 1,300° C. or any other temperature depending upon the maximum predetermined temperature of the application.

Engine 10 may include an electronic control unit 40, which may be part of any other apparatus which controls one or more of the electrical system or subsystems in a motor vehicle. Electronic control unit 40 may be a microprocessor 46 based unit including appropriate software and hardware, such as computer processing and memory devices 52.

Electronic control unit 40, which may simply comprise a glow plug control unit, may receive and read input data, such as data signals, originating as output data from a plurality of engine sensors, as well as receive and read input data from stored vehicle data (e.g. look-up tables), which may be stored in the electronic control unit 40 or at another location within the vehicle. As used herein, a data signal may include any signal which communicates information concerning the state of the sending device, such as a voltage output (e.g. electrical pulses that represent data).

More particularly, electronic control unit 40 may be configured and arranged to determine glow plug supply power to be applied from a power source 38 to the at least one glow plug 24 based on input from stored vehicle data and from a plurality of engine sensors.

For example, the engine sensors may include a fresh air intake mass airflow sensor 50, which also may be referred to a fresh mass airflow sensor, which may be understood as a mass airflow sensor which obtains data representative of fresh air mass airflow from the engine pre EGR (i.e. before the air is mixed with EGR gases passing through EGR valve 44). The intake mass airflow sensor 50 may be configured to send an output voltage signal to the electronic control unit 40 which is representative of the mass airflow read thereby.

The engine sensors may also include an intake manifold temperature sensor 58 which may obtains data representative of intake manifold temperature from the engine, and may be configured to send an output voltage signal to the electronic control unit 40 representative of the temperature of the engine intake manifold 48 read thereby. The engine sensors may also include a coolant temperature sensor 62 which may obtains data representative of coolant temperature from the engine, and may be configured to send an output voltage signal to the electronic control unit 40 representative of the temperature of the coolant (e.g. antifreeze solution) read thereby.

The engine 10 may also include an intake manifold pressure sensor 54, which may be used in conjunction with the fresh air intake mass airflow sensor 50 and intake manifold temperature sensor 58, as well as a predetermined map of volumetric efficiency stored in the vehicle, to calculate intake manifold total mass airflow.

Thus, engine 10 may also include a plurality of sensors for acquiring various input data relevant to the present disclosure, such as fresh air intake mass airflow sensor 50, intake manifold pressure sensor 54, intake manifold temperature sensor 58 and engine coolant temperature sensor 62. The various sensors may be suitably configured and arranged to perform their specific functions, including providing suitable data signals as known by one of ordinary skill in the art.

With regards to input data for target glow plug temperature, the electronic control unit 40 may obtain such from stored vehicle data stored in the electronic control unit 40 (e.g. look-up tables in a memory) or at another location within the vehicle. Target glow plug temperature may be any temperature, but typically varies between 1,000 and 1,350° C., depending upon the application. It should be understood that the stored data of targeted (reference) glow plug temperature may range from a single temperature to a plurality of temperatures. It should also be understood that the targeted glow plug temperature of the present model is not part of a feedback loop.

Thus, the present disclosure provides a glow plug control apparatus for an engine 10 of a motor vehicle, comprising at least one glow plug 24; a power source 38 to apply electric power to the at least one glow plug 24; and a control unit 40 comprising a microprocessor 46 configured and arranged to determine glow plug supply power to be applied from the power source 38 to the at least one glow plug 24 based on input from stored vehicle data and from a plurality of engine sensors 50, 54, 58 and 62, wherein the input includes data of engine operating parameters including fresh air intake mass airflow, intake manifold pressure, intake manifold temperature, coolant temperature, glow plug temperature and total fuel injection quantity.

More particularly, the microprocessor 46 is configured and arranged to determine glow plug power to be applied from the power source to the at least one glow plug 24 using a model which mathematically equates the engine operating parameters of fresh air intake mass airflow, intake manifold total mass airflow, intake manifold temperature, coolant temperature, glow plug temperature and total fuel injection quantity to the glow plug supply power to be applied from the power source 38 to the at least one glow plug 24.

For the model, the engine operating parameters of fresh air intake mass airflow, intake manifold total mass airflow, intake manifold temperature, coolant temperature, glow plug temperature and total fuel injection quantity each define an independent variable of the model.

Also for the model, at least two of the engine operating parameters of fresh air intake mass airflow, intake manifold total mass airflow, intake manifold temperature, coolant temperature, glow plug temperature and total fuel injection quantity define a cross-variable of the model. Here, glow plug temperature and intake manifold total mass airflow are shown to define a cross-variable.

The present disclosure also provides a method of glow plug control for a motor vehicle which may comprise providing the foregoing control unit 40, providing data of fresh air intake mass airflow, intake manifold total mass airflow, intake manifold temperature, coolant temperature, glow plug temperature and total fuel quantity to the control unit and determining glow plug power to be applied from the power source to the at least one glow plug with the microprocessor based on the data of fresh air intake mass airflow, intake manifold total mass airflow, intake manifold temperature, coolant temperature, glow plug temperature and total fuel injection quantity provided to the control unit.

While a preferred embodiment of the present invention(s) has been described, it should be understood that various changes, adaptations and modifications can be made therein without departing from the spirit of the invention(s) and the scope of the appended claims. The scope of the invention(s) should, therefore, be determined not with reference to the above description, but instead should be determined with reference to the appended claims along with their full scope of equivalents. Furthermore, it should be understood that the appended claims do not necessarily comprise the broadest scope of the invention(s) which the applicant is entitled to claim, or the only manner(s) in which the invention(s) may be claimed, or that all recited features are necessary.

What is claimed is:

1. A glow plug control apparatus for an engine of a motor vehicle, comprising:

at least one glow plug;

a power source to apply electric power to the at least one glow plug;

a control unit;

wherein the control unit receives input data from stored vehicle data and from a plurality of engine sensors, wherein the input data includes data of engine operating parameters including fresh air intake mass airflow, intake manifold total mass airflow, intake manifold temperature, coolant temperature, reference glow plug temperature and total fuel injection quantity;

wherein the control unit calculates, with an equation, a glow plug supply power level to be provided from the power source to the at least one glow plug based on the input data with at least one microprocessor;

wherein the control unit causes the glow plug supply power level to be provided from the power source to the at least one glow plug; and wherein the reference glow plug temperature is not part of a feedback loop.

2. The apparatus of claim 1 wherein:

the plurality of sensors comprise a fresh air intake mass airflow sensor.

3. The apparatus of claim 1 wherein:

the plurality of sensors comprise an intake manifold temperature sensor.

4. The apparatus of claim 1 wherein:

the plurality of sensors comprise a coolant temperature sensor.

5. The apparatus of claim 1 wherein:

the plurality of sensors comprise an intake manifold pressure sensor.

6. The apparatus of claim 1 wherein:

the stored vehicle data includes the data of the reference glow plug temperature.

7. The apparatus of claim 1 wherein:

the stored vehicle data includes the data of the total fuel injection quantity.

8. The apparatus of claim 1 wherein:

the stored vehicle data is from at least one look-up table stored in a memory of the vehicle.

9. The apparatus of claim 1 wherein:

the equation mathematically equates the engine operating parameters of the fresh air intake mass airflow, the intake manifold total mass airflow, the intake manifold temperature, the coolant temperature, the reference glow plug temperature and the total fuel injection quantity to the glow plug supply power level.

10. The apparatus of claim 9 wherein:

the equation is a nonlinear function.

11. The apparatus of claim 9 wherein:

the engine operating parameters of the fresh air intake mass airflow, the intake manifold total mass airflow, the intake manifold temperature, the coolant temperature, the reference glow plug temperature and the total fuel injection quantity each define an independent variable of the equation.

12. The apparatus of claim 9 wherein:

at least two of the engine operating parameters of the fresh air intake mass airflow, the intake manifold total mass airflow, the intake manifold temperature, the coolant temperature, the reference glow plug temperature and the total fuel injection quantity define a cross-variable of the equation.

13. The apparatus of claim 9 wherein:

the control unit calculates the glow plug power level using the equation of $$\begin{aligned}\text{GP_Power}=&a+(b*\text{GP_Temp})+(c*\text{Air_Intake_MAF})+\\&(d*\text{Intake_Manifold_MAF})+\\&(e*\text{Intake_Manifold_Temp})+(f*\text{Coolant_Temp})+\\&(g*\text{Fuel_Quantity})+\\&(h*\text{GP_Temp}*\text{Intake_Manifold_MAF})\end{aligned}$$

where:

GP_Power=the glow plug supply power level;

GP_Temp=the reference glow plug temperature;

Air_Intake_MAF=the fresh air intake mass airflow;

Intake_Manifold_MAF=the intake manifold total mass airflow;

Intake_Manifold_Temp=the intake manifold temperature;

Coolant_Temp=the engine coolant temperature;

Fuel_Quantity=the total fuel injection quantity per injection period; and wherein the letters a-h are coefficient values.

14. A method of glow plug control for a motor vehicle comprising:

receiving input data at a control unit from stored vehicle data and from a plurality of engine sensors, wherein the input data includes data of engine operating parameters including fresh air intake mass airflow, intake manifold total mass airflow, intake manifold temperature, coolant temperature, reference glow plug temperature and total fuel quantity to the control unit, wherein the reference glow plug temperature is not part of a feedback loop;

calculating, with an equation and at least one microprocessor of the control unit, a glow plug supply power level to be provided from the power source to the at least one glow plug;

causing, using the control unit, the glow plug power supply level to be provided from the power source to the at least one glow plug.

15. The method of claim 14 wherein:

the input data of the fresh air intake mass airflow is provided at least in part from a fresh air intake mass airflow sensor of the engine.

16. The method of claim 14 wherein:

the input data of the intake manifold temperature is provided at least in part from an intake manifold temperature sensor of the engine.

17. The method of claim 14 wherein:

the input data of the coolant temperature is provided at least in part from a coolant temperature sensor of the engine.

18. The method of claim 14 wherein:

the input data of the intake manifold total mass airflow is provided at least in part from each of an intake manifold pressure sensor, a fresh air intake mass airflow sensor, an intake manifold temperature sensor and a map of volumetric efficiency of the engine.

19. The method of claim 14 wherein:

the input data of the reference glow plug temperature is provided from the stored vehicle data.

20. The method of claim 14 wherein:

the input data of the total fuel injection quantity is provided from the stored vehicle data.

21. The method of claim 14 wherein:

the stored vehicle data is from at least one look-up table stored in a memory of the vehicle.

22. The method of claim 14 wherein:

the plurality of sensors comprise a fresh air intake mass airflow sensor, an intake manifold total mass airflow sensor, an intake manifold temperature sensor and a coolant temperature sensor.

23. The method of claim 14 wherein:

the input data of the reference glow plug temperature received at the control unit is from the stored vehicle data.

24. The method of claim 14 wherein:

the input data of the fuel injection quantity received at the control unit is from the stored vehicle data.

25. The method of claim 14 wherein:

the equation mathematically equates the engine operating parameters of the fresh air intake mass airflow, the intake manifold total mass airflow, the intake manifold temperature, the coolant temperature, the reference glow plug temperature and the total fuel injection quantity to the glow plug supply power level.

26. The method of claim 25 wherein:

the equation is a nonlinear function.

27. The method of claim 25 wherein:

the engine operating parameters of the fresh air intake mass airflow, the intake manifold total mass airflow, the intake manifold temperature, the coolant temperature, the reference glow plug temperature and the total fuel injection quantity each define an independent variable of the equation.

28. The method of claim 25 wherein:

at least two of the engine operating parameters of the fresh air intake mass airflow, the intake manifold total mass airflow, the intake manifold temperature, the coolant temperature, the reference glow plug temperature and the total fuel injection quantity define a cross-variable of the equation.

29. The apparatus of claim 1 wherein:

causing, using the control unit, the glow plug power to be provided from said power source to said at least one glow plug uses the equation of $$\begin{aligned}\text{GP_Power}=a+(b*\text{GP_Temp})+(c*\text{Air_Intake_MAF})+\\(d*\text{Intake_Manifold_MAF})+\\(e*\text{Intake_Manifold_Temp})+(f*\text{Coolant_Temp})+\\(g*\text{Fuel_Quantity})+\\(h*\text{GP_Temp}*\text{Intake_Manifold_MAF})\end{aligned}$$

where:

GP_Power=the glow plug supply power level;

GP_Temp=the reference glow plug temperature;

Air_Intake_MAF=the fresh air intake mass airflow;

Intake_Manifold_MAF=the intake manifold total mass airflow;

Intake_Manifold_Temp=the intake manifold temperature;

Coolant_Temp=the engine coolant temperature;

Fuel_Quantity=the total fuel injection quantity per injection period; and wherein the letters a-h are coefficient values.

* * * * *